United States Patent [19]

Gansert

[11] 4,082,400

[45] Apr. 4, 1978

[54] MULTI-POLE PLUG-AND-SOCKET CONNECTING ARRANGEMENT

[75] Inventor: Willi Gansert, Kornwestheim, Germany

[73] Assignee: Robert Bosch GmbH, Stuttgart, Germany

[21] Appl. No.: 731,503

[22] Filed: Oct. 12, 1976

Related U.S. Application Data

[63] Continuation of Ser. No. 517,094, Oct. 22, 1974, abandoned.

[30] Foreign Application Priority Data

Nov. 2, 1973 Germany ..... 2354795

[51] Int. Cl.[2] ..... H01R 13/40; H01R 13/54

[52] U.S. Cl. ..... 339/91 R; 339/217 R

[58] Field of Search ..... 339/75, 91, 94, 103, 339/214–217

[56] References Cited

U.S. PATENT DOCUMENTS

| | | | |
|---|---|---|---|
| 2,669,702 | 2/1954 | Klostermann | 339/75 M |
| 2,725,541 | 11/1955 | Born et al. | 339/91 R |
| 3,087,137 | 4/1963 | Linn | 339/217 R |
| 3,122,407 | 2/1964 | Cowe | 339/217 R |
| 3,172,718 | 3/1965 | Lalonde | 339/217 R |
| 3,501,736 | 3/1970 | Norris | 339/217 R |
| 3,951,501 | 4/1976 | Bauerle et al. | 339/91 R |

*Primary Examiner*—Joseph H. McGlynn
*Attorney, Agent, or Firm*—Michael J. Striker

[57] ABSTRACT

A plug connector is provided with a plurality of electrical contacts. A socket connector is provided with a plurality of electrical contacts corresponding to the electrical contacts of the plug connector. A mounting hook is provided on one of the connectors, and a cooperating holding portion is provided on the other of the connectors. The mounting hook is hooked behind the holding portion for swinging movement of the plug connector relative to the socket connector from a first position to a second position. The mounting hook and the holding portion are disconnectable from each other to permit disconnection of the plug connector from the socket connector. A snap-latch is provided on one of the connectors and a cooperating catch is provided on the other of the connectors. The snap-latch and catch are so positioned that the snap-latch engages the catch with a snap action only when the plug connector is swung from the first position to the second position thereof.

16 Claims, 7 Drawing Figures

MULTI-POLE PLUG-AND-SOCKET CONNECTING ARRANGEMENT

This is a continuation of application Ser. No. 517,004, filed Oct. 22, 1974, now abandoned.

BACKGROUND OF THE INVENTION

The invention relates to a multi-pole connecting arrangement comprised of a plug connector and a socket connector, each provided with a carrier for one or more rows of electrical contacts.

A connecting arrangement is already known which is comprised of a plug connector and a socket connector. The housing of the plug connector is provided on two opposite sides with grooves into which engage the U-shaped bracket of two over-center latches mounted on the socket connector. Such connections are complicated to open and to close, because the plug connector cannot be easily connected to the socket connector by feel alone, i.e., when the access is so poor as to make impossible visual observation of the connecting operation. Additionally, the connections which are made are not non-interchangeable ones. Furthermore, the connecting arrangements of this type require too much space for the swinging of the bracket portions of the over-center latches and for the manipulation of the brackets. The scarceness of space and the difficulty of access in the case of internal combustion engines, for example, are ever increasing, so that the known connecting arrangement can no longer be satisfactorily employed in that context.

SUMMARY OF THE INVENTION

It is accordingly an object of the invention to provide a multi-pole plug-and-socket connecting arrangement so designed and constructed that the plug connector of the connecting arrangement can be blindly and non-interchangeably connected to the socket connector of the connecting arrangement, in a manner which is highly vibration-resistant, but which nonetheless makes for easy disconnection of the plug and socket connectors when desired.

These objects, and others which will become more understandable from the description, below, of a preferred embodiment of the invention, can be met, according to one advantageous concept of the invention, by providing the plug connector of the connecting arrangement with a mounting hook which engages behind a holding part of the socket connector, with the plug connector thereafter being pivotable about such holding part and swingable into a position in which a latch-type arrangement snaps into place establishing a firm connection between the plug connector and the socket connector.

Especially when the multi-pole connecting arrangement is to be employed in automotive vehicles, it should be so designed and constructed as to be protected against sprayed and splashed water. Advantageously for this purpose, the plug connector has a housing in which is positioned a sealing ring which encircles the carrier member which carries the electrical contacts of the plug connector. In addition, the socket connector is configurated as the cover portion of a housing accommodating an electronic control device, and the socket connector is provided with a projecting sealing ridge adapted to press against and establish a seal with the aforementioned sealing ring. The individual conductors which pass into the plug connector often have different respective diameters. In order to make the plug connector waterproof at the portion thereof where the electrical conductors pass into the plug connector, independently of the number of electrical conductors and their diameters, it is advantageous to provide the plug connector with a housing into which project the ends of the electrical conductors of the joined conductor group or cable, with the ends of the electrical conductors being connected to specially provided parts arranged in the carrier for the electrical contacts, and with the portion of the plug connector housing through which the electrical conductors enter the plug connector being sealed off, and with the conductors at that portion being maintained relieved of tensile stress.

To prevent the contact springs from slipping out of the carrier for the electrical contacts in the event of incomplete engagement between the plug connector and the socket connector, the aforementioned specially provided parts which engage the contact springs are secured by means of at least one arresting member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

A multi-pole connecting arrangement is comprised of a plug connector 1 and a socket connector 2. The terms plug connector and socket connector are used herein to refer to the nature of the mechanical connection which can be effected between the two connectors. The electrical contacts associated with the plug connector may be male or female contacts; likewise the electrical contacts associated with the socket connector may be male or female contacts.

Figure 2:
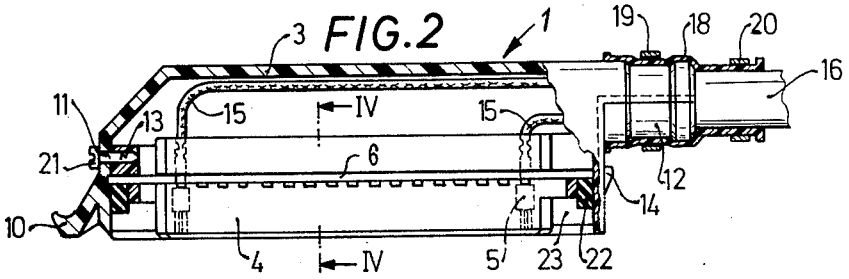
FIG. 2 is a longitudinal section of the multi-pole plug connector of FIG. 1.
Figure 4:
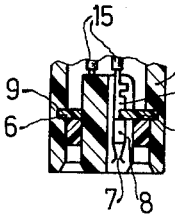
FIG. 4*a* is a section taken along line IV—IV of FIG. 2.
FIG. 4*b* is a section taken along line *b—b* in FIG. 4*a;*.
Figure 4A:
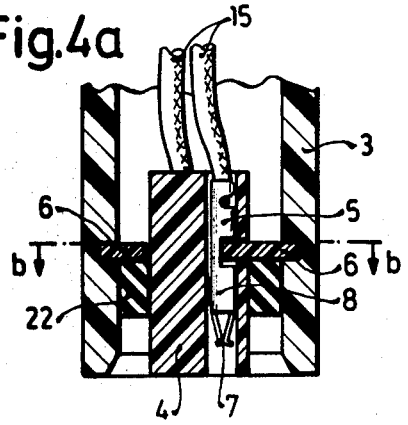
Figure 4B:
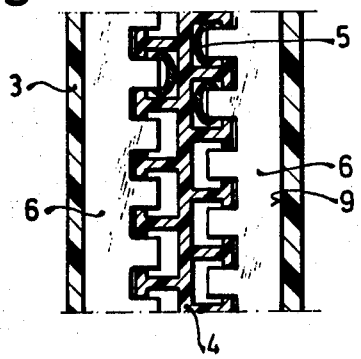

The plug connector 1 is comprised of a plug connector housing 3 having approximately the configuration of a pistol grip, and is furthermore comprised of a contact carrier 4 (see FIGS. 2 and 4*a*). In the contact carrier 4 (see FIG. 4*a*), 35 contact springs 5 are mounted, arranged in two rows, with the contact springs 5 of one row being staggered relative to those of the other row, in this particular embodiment. Each row of contact springs 5 is secured in the connector 6 by means of a respective comb-shaped holding member housing 3. To that end, the comb-shaped holding member 6 grips with its projecting portions behind respective sections 8 of the contact springs 5, the sections 8 carrying the springy contact ends 7. The back edge portion of each comb-shaped holding member 6 is firmly held in a respective lateral groove 9 provided in the wall of the connector housing 3 (FIG. 4*a*). If one of the contact springs 5 is not engaged in place, then the contact carrier 4 provided with the comb-shaped holding members 6 cannot be mounted in the plug connector housing 3. The comb-like shape of the holding members 6 is most clearly seen in FIG. 4*b*.

The illustrated connecting arrangement is narrow and generally of rectangular configuration. The plug connector housing 3 has a corresponding rectangular periphery, with the long sides of the rectangle being several times the size of the short sides. At one of the short sides, the plug connector housing 3 is provided with a mounting hook 10. The mounting hook 10 is located in the same plane as the edge of the plug connector housing 3 which, when the plug and socket connectors are joined, lies against the socket connector 2. Above the mounting hook 10 there is provided in the plug connector housing 3 a longitudinal bore 11. At the other short end thereof, the plug connector housing 3 is provided with the upper half of a cable-receiving socket 12 which projects rightwards beyond the side wall of the housing 3.

The contact carrier 4 is provided at its left end (as seen in FIG. 2) with a portion having a threaded bore 13 aligned with the longitudinal bore 11. At the other end of the contact carrier 4 there is formed the lower half of the cable-receiving socket 12. In addition, this end of the contact carrier 4 is provided with a snap-latch 14. A group of electrical conductors 15 passes into the interior of plug connector housing 3 via the cable-receiving socket portion 12 from a non-illustrated electronic arrangement to be controlled. These electrical conductors 15 are electrically connected to respective ones of the 35 contact springs 5. Into the two halves of the cable-receiving socket portion 12 there projects an insulating tube, sleeve or pipe 16. The insulating sleeve 16 surrounds the portions of the conductors 15 projecting rightwards out of the socket portion 12 and joins them mechanically together to form a unitary cable-like structure. The two halves of the socket portion 12 are provided with respective halves of an annular groove 17. A sleeve 18 surrounds and firmly engages the socket portion 12 and the insulating sleeve 16. The sleeve 18, in the region of the annular groove 17, is clamped onto the socket portion 12 by means of a clamping ring 19 and, in the region of the sleeve 16, is clamped onto the sleeve 16 by means of a second clamping ring 20. As a result, on the one hand, the contact carrier 4 inserted into the plug connector housing 3 and the plug connector housing 3 are firmly held together, with the cable-receiving socket portion 12 being closed off, and, on the other hand, the branching cable structure 15, 16 passing into the plug connector housing 3 through the socket portion 12 is water-tightly sealed, and accordingly protected from sprayed or splashed water.

At the ends thereof adjoining the mounting hook 10, the plug connector housing 3 and the contact carrier 4 are connected to each other by means of a screw 21 passing through the longitudinal bore 11 and the threaded bore 13. A sealing ring 22 is inserted into the thusly assembled plug connector 1. The sealing ring 22 surrounds the part of the contact carrier 4 which holds the contact springs 5 and with its outwardly facing surface abuts against the side walls of a downwardly projecting ridge portion 23 of the plug connector housing 3.

Figure 1:
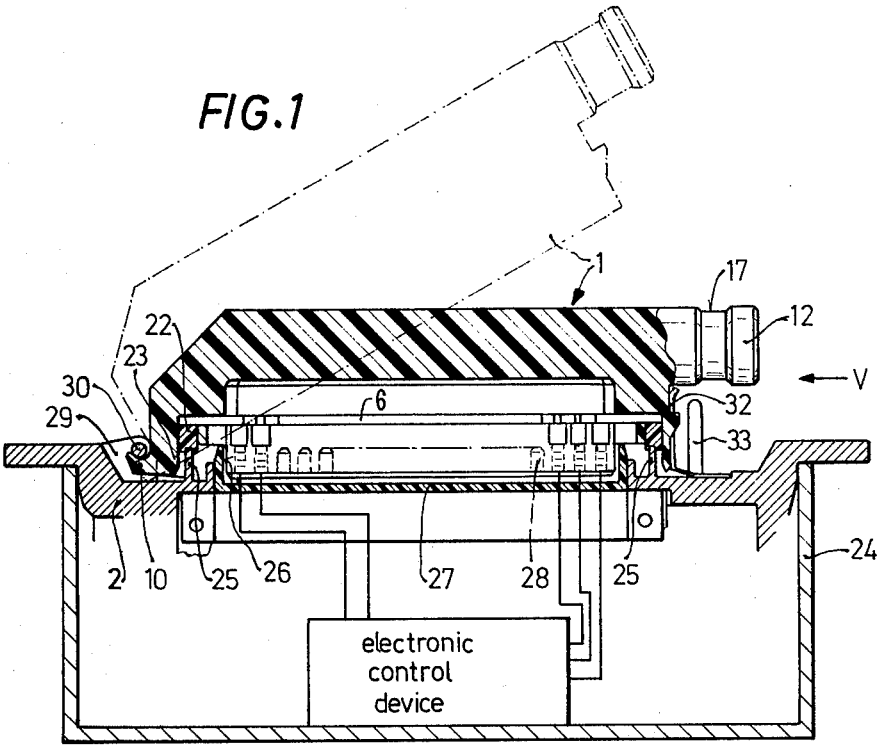
FIG. 1 shows a multi-pole plug connector connected to a socket connector, partly in longitudinal section.

The socket connector 2 is comprised of a cast or molded body and serves as the cover of a housing 24 which contains an electronic control device. The socket connector 2 can be made of metal, for example cast light metal, or else can be made of synthetic plastic material, as are preferably the plug connector housing 3 and the contact carrier 4. At the outer side of socket connector 2 (upper side as viewed in FIG. 1), there is provided an upwardly projecting sealing ridge 25. The sealing ridge 25 surrounds and bounds a generally rectangular opening 26 in the middle of the socket connector 2. A contact carrier 27 is arranged in this rectangular opening. The contact carrier 27 is comprised of synthetic plastic material and carries 35 male contacts 28, arranged in two rows in correspondence to the disposition of the female contact springs 5 on the contact carrier 4 of the plug connector 1. The male contacts 28 are electrically connected to the electronic control device located in the housing 24.

At one of the two short ends of the socket connector 2 there are provided two guide or positioning projections 29. The positioning projections 29 are disposed parallel to each other, parallel to the long sides of the socket connector 2, and accordingly parallel to the two rows of male contacts 28. The two positioning projections 29 are connected to each other by means of a pin 30. When the plug connector 1 is to be connected to the socket connector 2, the mounting hook 10 initially engages and grips the connecting pin 30 from below, as shown in dash-dot lines in FIG. 1, and then the plug connector 1 is swung downwards, pivoting about pin 30, and moved towards socket connector 2. The guide or positioning projections 29 prevent the plug connector 1 from being pressed with a skew orientation against the socket connector 2, which could possibly damage the contacts 28. In addition, and very importantly for practical reasons, the mounting hook 10 of the plug connector 1 can be blindly positioned between the two guide or positioning projections 29. As a result, the plug connector 1 can be reliably and readily connected to the socket connector 2 even when the socket connector 2 is located relatively inaccessibly, for example in a position such that a mechanic can stretch his arm into an engine compartment, feel for and find the socket connector 2 and then connect to it the connector 1, without his actually being able to bring his eyes close to the socket connector 2, or without his being able to see the socket connector 2 at all. When the plug connector 1 is connected to the socket connector 2, the female contact springs 5 become plugged onto the male contacts 28 one after the other. Only a relatively small force need be exerted to swing the plug connector 1 into position on the socket connector 2. Nonetheless, when the plug connector 1 and socket connector 2 are actually connected, the individual male contacts 28 and female contact springs 5 are pressed together with relatively great force, resulting in the establishment of a very reliable electrical engagement between the male and female contacts.

Mounted on the outer side of socket connector 2 (the side facing the viewer in FIG. 3) is an angular catch spring 31 provided with a snap-latch opening 32. When the plug connector 1 is swung and pressed all the way down onto the socket connector 2, the snap-latch 14 of the plug connector 1 snaps into the snap-latch opening 32. The male contacts 28 and female contacts 5 are electrically engaged and protected against sprayed or splashed water by means of the sealing ring 22 and the sealing ridge 25 pressing thereagainst. Before the snap-latch 14 actually enters into the snap-latch opening 32, the effect of the resilient sealing ring 22 is to swing the plug connector 1 away from the socket connector 2. In that event, at least the pair of associated contacts 5, 28 closest to the catch spring 31 remains electrically unengaged. The plug and socket connecting arrangement is for this reason so connected in circuit that the just-mentioned contact pair 5, 28 effects the connection between the electronic control device and the controlled device, for example the electrically controlled fuel-injection valves of an internal combustion engine. For example, so long as the end contact pair 5, 28 is not closed, the controlled machine cannot be caused to operate at all.

Figure 3:
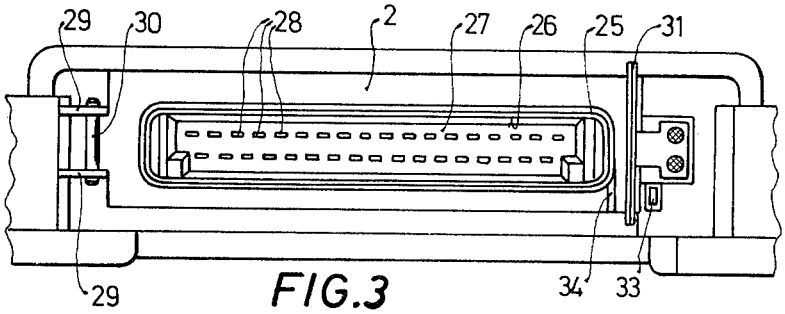
FIG. 3 is a view looking down onto the socket connector, with the plug connector removed.
Figure 5:
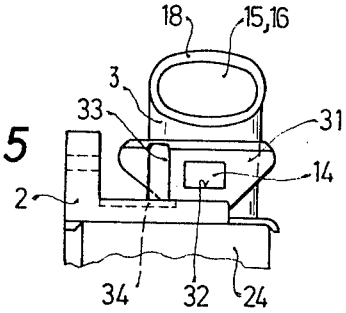
FIG. 5 is a side view of the arrangement of FIG. 1 as seen in the direction of the arrow V in FIG. 1.

In order to disconnect the plug connector 1 from the socket connector 2, the catch spring 31 is bent away from the plug connector 1 (bent rightwards as viewed in FIG. 3). As a result of such bending, the snap-latch 14 is released from the snap-latch opening 32. The plug connector 1 can now be swung about pin 30 away from the socket connector 2. Thereafter, the mounting hook 10 hooked under the connecting pin 30 can be removed from the latter, and thereby the plug connector 1 removed from the socket connector 2 altogether. To limit the bending movement of the catch spring 31 during the disconnecting of plug connector 1 from socket connector 2, the outer side of the socket connector 2 is provided with a stop member 33. To facilitate disconnection of the plug connector 1 when the socket connector 2 is located at a relatively inaccessible position, there is provided on the upper side of socket connector 2 a support portion 34 against which the end of a simple tool, such as a screwdriver, can be held as the tool is swung down to effect bending of the catch spring 31.

The plug connector and socket connector of the described connecting arrangement can be blindly connected and disconnected when access to them is poor, and furthermore form a vibration-resistant and watertight connection. For this reason, for maintenance work, the plug and socket connectors can be easily disconnected, with the plug connector of a testing arrangement being connected between them.

It will be understood that each of the elements described above, or two or more together, may also find a useful application in other types of constructions differing from the types described above.

While the invention has been illustrated and described as embodied in a connecting arrangement wherein female electrical contacts are provided on the plug connector and male electrical contacts on the socket connector, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore such adaptations should and are intended to be comprehended within the meaning and range of equivalence of the following claims.

What is claimed as new and desired to be protected by Letters Patent is set forth in the appended claims:

1. A multi-pole connecting arrangement comprising, in combination, a plug connector provided with a plurality of electrical contacts arranged in at least one row, a socket connector provided with a plurality of electrical contacts arranged in at least one row corresponding to the electrical contacts of said plug connector; a mounting hook on one of said connectors and a cooperating holding portion on the other of said connectors, said mounting hook being hooked behind said holding portion for swinging movement of said plug connector relative to said socket connector from a first to a second position, said first position being a position in which not all of the contacts of said socket connector are in electrical engagement with the corresponding contacts of said plug connector, said second position being a position in which all of the contacts of said socket connector are in electrical engagement with the corresponding contacts of said plug connector, and said mounting hook and said holding portion being disconnectable from each other to permit disconnection of said plug connector from said socket connector; and a snap-latch on one of said connectors and a cooperating catch on the other of said connectors, said snap-latch and catch being so positioned that said snap-latch engages said catch with a snap action only when said plug connector is swung from said first position to said second position, and wherein said plug connector includes means securing the contacts of said plug connector in position on said plug connector, the securing means including a holding member discrete from the remainder of the plug connector, the contacts of the row of contacts of the plug connector being positioned and caused to form a row by said holding member, and said holding member being in turn positioned on and supported by the remainder of the plug connector, said holding member being a comb-shaped member having a row of comb teeth, the comb teeth of the holding member gripping behind respective ones of the row of electrical contacts of said plug connector, the holding member having ends which extend transversely of the direction in which the comb teeth row extends, said ends being located interiorly of and being confined by the adjoining portions of the plug connector, said adjoining portions of the plug connector preventing shifting of the comb-shaped holding member in the direction in which the comb teeth row extends, said comb-shaped holding member having a longitudinal edge running along the side of the holding member opposite to the side provided with the comb teeth, the remainder of the plug connector being provided with a longitudinal groove into which the said longitudinal edge can be inserted and held if and only if all the individual contacts secured by the holding member are properly positioned relative to the respective ones of the teeth of the comb-shaped holding member.

2. A connecting arrangement as defined in claim 1, wherein said mounting hook is provided on said plug connector, and wherein said cooperating holding portion is provided on said socket connector.

3. A connecting arrangement as defined in claim 1, wherein said snap-latch is provided on said plug connector, and wherein said cooperating catch is provided on said socket connector.

4. A connecting arrangement as defined in claim 1, wherein said plug connector is comprised of a plug connector housing, a carrier inside said plug connector housing housing carrying said holding member of said plug connector, and a sealing ring in said plug connector housing surrounding said carrier.

5. A connecting arrangement as defined in claim 1, wherein said contacts of said plug connector are spring contacts.

6. A connecting arrangement as defined in claim 1, wherein said catch is made of resilient material and is deformable in a direction releasing said snap-latch to permit movement of said plug connector from said second position back to said first position.

7. A connecting arrangement as defined in claim 1, wherein said holding part is comprised of lateral positioning portions for properly positioning said mounting hook.

8. A connecting arrangement as defined in claim 1, wherein said socket connector is comprised of a metal casting.

9. A connecting arrangement as defined in claim 1, wherein said socket connector is comprised of synthetic plastic material.

10. A connecting arrangement as defined in claim 1, wherein said plug connector is comprised of a plug connector housing and a carrier inside said plug connector housing carrying said holding member, wherein said holding member is an elongated flat holding member having a lateral edge portion, and wherein said carrier is provided with an elongated groove in which said lateral edge portion is received and held.

11. A connecting arrangement as defined in claim 1, wherein said socket connector has two opposite ends, and wherein said mounting hook and cooperating holding portion are located adjacent one of said ends, and wherein said snap-latch and cooperating catch are located adjacent the other of said ends.

12. A connecting arrangement as defined in claim 11, wherein said mounting hook and said snap-latch are provided on said plug connector, and wherein said holding portion and said catch are provided on said socket connector.

13. A connecting arrangement as defined in claim 1, wherein said plug connector is comprised of a plug connector housing having an opening, and further including a plurality of electrical conductors passing into said plug connector housing through said opening, means mechanically connecting together the portions of said conductors which pass through said opening to form a cable section from which the individual conductors branch off inside said plug connector housing, said conductors having respective conductor ends connected to respective ones of said contacts of said plug connector, and said opening with said conductors passing therethrough being seal-tightly closed off to prevent the entrance of sprayed or splashed water into the interior of said plug connector housing through said opening.

14. A connecting arrangement as defined in claim 13, wherein the portions of said conductors passing through said openings are substantially free of tensile stress.

15. A connecting arrangement as defined in claim 1, and further including an electronic control device connected to said contacts of said socket connector, a housing accommodating said electronic control device and having an open end, and said socket connector being so configurated and positioned as to constitute a cover for said housing.

16. A connecting arrangment as defined in claim 15, wherein said socket connector is provided with a carrier supporting said contacts of said socket connector and a sealing ridge surrounding said carrier and establishing a seal between said socket connector and said plug connector when said plug connector is in said second position.

* * * * *